US007942408B2

(12) United States Patent
Kato et al.

(10) Patent No.: US 7,942,408 B2
(45) Date of Patent: May 17, 2011

(54) IMAGE FORMING APPARATUS AND METHOD FOR TRANSPORTING SHEET THEREOF

(75) Inventors: Hiroyo Kato, Shizuoka-Ken (JP); Yoshikatsu Kamisuwa, Tokyo (JP); Kazumasa Yasui, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 311 days.

(21) Appl. No.: 12/207,291

(22) Filed: Sep. 9, 2008

(65) Prior Publication Data

US 2009/0066016 A1 Mar. 12, 2009

Related U.S. Application Data

(60) Provisional application No. 60/971,555, filed on Sep. 11, 2007.

(51) Int. Cl.
*B65H 7/02* (2006.01)

(52) U.S. Cl. ..... 271/227; 271/226

(58) Field of Classification Search ..... 271/227
See application file for complete search history.

(56) References Cited

U.S. PATENT DOCUMENTS

| | | | | | |
|---|---|---|---|---|---|
| 4,511,242 | A | * | 4/1985 | Ashbee et al. | 399/395 |
| 4,971,304 | A | * | 11/1990 | Lofthus | 271/227 |
| 5,140,340 | A | * | 8/1992 | Stephenson | 347/177 |
| 5,169,140 | A | * | 12/1992 | Wenthe, Jr. | 271/228 |
| 5,236,072 | A | * | 8/1993 | Cargill | 194/207 |
| 5,533,721 | A | * | 7/1996 | Takashimizu | 271/109 |
| 5,678,159 | A | * | 10/1997 | Williams et al. | 399/395 |
| 5,697,608 | A | * | 12/1997 | Castelli et al. | 271/228 |
| 6,019,365 | A | * | 2/2000 | Matsumura | 271/227 |
| 6,062,369 | A | * | 5/2000 | Negishi | 194/207 |
| 6,488,275 | B2 | * | 12/2002 | Schlageter | 271/10.01 |
| 7,703,766 | B2 | * | 4/2010 | Kao | 271/227 |
| 2002/0074718 | A1 | * | 6/2002 | Schlageter | 271/227 |
| 2005/0012263 | A1 | * | 1/2005 | Koyanagi et al. | 271/227 |
| 2006/0163801 | A1 | * | 7/2006 | Dejong et al. | 271/227 |
| 2009/0057992 | A1 | * | 3/2009 | Katou et al. | 271/227 |
| 2009/0146370 | A1 | * | 6/2009 | Kao | 271/227 |
| 2009/0309298 | A1 | * | 12/2009 | Herrmann | 271/227 |
| 2010/0148429 | A1 | * | 6/2010 | Kao | 271/227 |
| 2010/0158595 | A1 | * | 6/2010 | Kao | 399/395 |

FOREIGN PATENT DOCUMENTS

| | | | |
|---|---|---|---|
| JP | 6-171796 | | 6/1994 |
| JP | 9-71349 | | 3/1997 |
| JP | 10-35948 | | 2/1998 |
| JP | 2005-41623 | | 2/2005 |
| JP | 2005-350155 | | 12/2005 |
| JP | 2005350155 | A * | 12/2005 |
| JP | 2008081303 | A * | 4/2008 |

* cited by examiner

*Primary Examiner* — Stefanos Karmis
*Assistant Examiner* — Howard Sanders
(74) *Attorney, Agent, or Firm* — Patterson & Sheridan, LLP

(57) ABSTRACT

Provided is an image forming apparatus including: a first sensor which is provided on a transportation path of a sheet and detects a first passage time of the sheet; a second sensor which is provided at a position different from the position of the first sensor in a transportation direction of the sheet and a direction perpendicular to the transportation direction and detects a second passage time of the sheet; a skew determination unit which determines a skew amount of the sheet based on the first passage time detected by the first sensor and the second passage time detected by the second sensor; and a correction control unit which controls correction of a skew of the sheet on the basis of the skew amount determined by the skew determination unit.

18 Claims, 9 Drawing Sheets

IMAGE FORMING APPARATUS AND METHOD FOR TRANSPORTING SHEET THEREOF

CROSS-REFERENCE TO RELATED APPLICATIONS

This application is based upon and claims the benefit of priority from: U.S. provisional application 60/971,555, filed on Sep. 11, 2007, the entire contents of each of which are incorporated herein by reference.

TECHNICAL FIELD

The present invention relates to an image forming apparatus and a method for transporting a sheet thereof, and more particularly, to an image forming apparatus, which is capable of correcting a skew when the skew occurs in a sheet transported from a feed unit, and a method for transporting a sheet thereof.

BACKGROUND

An image forming apparatus using an electrophotographic method, such as a copier, a printer or a multi-functional peripheral (MFP), transfers a toner image formed on a photoconductive drum onto a sheet so as to perform printing. The transfer is performed in a transfer position near the outer surface of the photoconductive drum. A sheet before printing is contained in a sheet cassette or the like, and the sheet is picked up from the sheet cassette upon printing and is guided to the transfer position via a transportation path composed of several rollers and the like.

While the sheet is transported from the sheet cassette to the transfer position, the sheet may be skewed. If the skew occurs, a line of a front end of the sheet is not parallel to a direction perpendicular to a transportation direction of the sheet and the sheet is transported with any angle. This angle may be called a skew angle or a skew amount. A state in which the skew angle is zero is an ideal state. When the toner image is transferred from the photoconductive drum to the sheet in a state in which the skew occurs, an inclined image is printed on the sheet and it is unfavorable.

Generally, a pair of rollers for correcting the skew, such as registration roller, is provided just before the transfer position. The rotation of the registration roller is stopped at a time point when the printing is instructed. The front end of the sheet which is transported from the transportation path is brought into contact with a nip of the registration roller of which the rotation is stopped. If the skew occurs in the sheet, one end of the front end line of the sheet is brought into contact with the nip first. Thereafter, the sheet is transported from the transportation path and deflection occurs in the vicinity of the end of the sheet which is in contact with the nip first. Then, the other end of the sheet also reaches the nip and the front end line of the sheet is parallel to the line of the nip. The deviation in the front end line of the sheet is absorbed by the deflection occurring in the vicinity of the end of the sheet so as to correct the skew. When it is determined that the skew has been corrected and the front end line of the sheet becomes parallel to the line of the nip (that is, when it is determined that the correction of the skew is completed), the rotation of the registration roller is started and the front end line of the sheet is transported to the transfer position through the nip of the registration roller.

The completion of the skew correction is determined whether a predetermined period (skew correction period) is elapsed after the front end of the sheet is brought into contact with the registration roller. If the skew correction period is too short, sufficient deflection necessary for the skew correction cannot be obtained and thus the correctable skew amount can be decreased.

On the other hand, if the skew correction period is set to be long, the correctable skew amount is increased, but a period from a time point when the front end of the sheet is brought into contact with the registration roller and a time point when the rotation of the registration roller is started is increased. Thus, printing throughput deteriorates. In addition, if the skew correction period is set to be long, a margin of the transportation period which has been set in order to print one sheet is decreased and thus a paper jam is easy to occur. Further, an unnecessarily large deflection occurs in a sheet with a small skew amount so as to cause paper wrinkle.

In order to solve these problems, a technique of detecting a skew amount before a sheet reaches registration roller and adjusting a skew correction period according to the detected skew amount is disclosed in JP-A 2005-350155.

In the technique disclosed in JP-A 2005-350155, the skew amount is detected using an edge sensor for detecting a side edge of the sheet and the sheet transportation amount (skew correction period) is adjusted according to the detected skew amount.

However, since the edge sensor is used for detecting the skew amount in the technique disclosed in JP-A 2005-350155, the sheet transportation amount needs to be changed according to the sheet size (sheet width) of a side direction and thus a process becomes complicated. In order to perform a function for detecting the edge, a predetermined gap needs to be provided between the edge sensor and the registration roller and a position where the edge sensor is provided is restricted. In addition, in the technique disclosed in JP-A 2005-350155, since the detected skew amount is influenced by the sheet transportation period, the skew amount cannot be accurately detected if the transportation period is changed by abrasion of a transportation roller located on the sheet transportation path.

SUMMARY

The present invention is contrived to solve the above-mentioned problems and an object of the present invention is to provide an image forming apparatus, which is capable of accurately detecting a skew amount of a sheet and properly correcting a skew according to the detected skew amount without adding a special sensor, even when a transportation period is changed by abrasion of a roller, and a method for transporting the sheet thereof.

According to an aspect of the present invention, there is provided an image forming apparatus including: a first sensor which is provided on a transportation path of a sheet and detects a first passage time of the sheet; a second sensor which is provided at a position different from the position of the first sensor in a transportation direction of the sheet and a direction perpendicular to the transportation direction and detects a second passage time of the sheet; a skew determination unit which determines a skew amount of the sheet based on a difference between the first passage time detected by the first sensor and the second passage time detected by the second sensor; and a correction control unit which performs control for correcting a skew of the sheet on the basis of the skew amount determined by the skew determination unit.

According to another aspect of the present invention, there is provided a method for transporting a sheet, the method including: detecting a first passage time of the sheet by a first sensor provided on a transportation path of the sheet; detecting a second passage time of the sheet by a second sensor which is provided at a position different from the position of the first sensor in a transportation direction of the sheet and a direction perpendicular to the transportation direction; determining a skew amount of the sheet based on a difference between the first passage time detected by the first sensor and the second passage time detected by the second sensor; and controlling correction of a skew of the sheet on the basis of the skew amount.

DETAILED DESCRIPTION

An image forming apparatus and a method for transporting a sheet thereof according to embodiments of the present invention will be described with reference to the accompanying drawings.

(1) Configuration of Image Forming Apparatus

Figure 1:
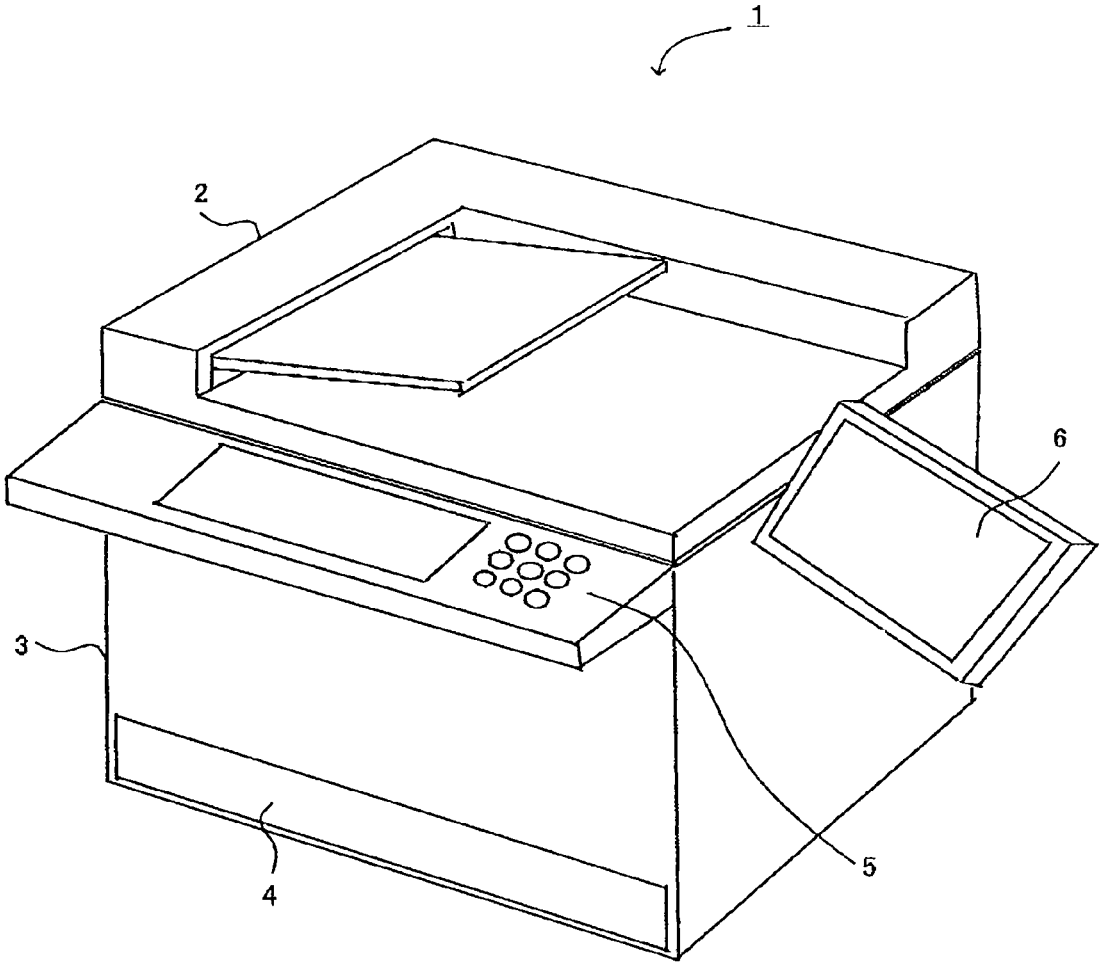
FIG. 1 is a perspective view showing an example of appearance of an image forming apparatus according to an aspect of the present invention.

FIG. 1 is a view showing the appearance of a copier (or an MFP) as a typical example of an image forming apparatus 1 according to the present embodiment.

The image forming apparatus 1 includes a read unit 2, an image forming unit 3 and a feed unit 4. The read unit 2 optically reads an original laid on a platen or an original fed from an auto document feeder (ADF) and generates image data.

The image forming unit 3 prints the image data on a sheet fed from the feed unit 4 using an electrophotographic method. In the image forming unit 3, a control panel 5 for allowing a user to perform various types of manipulations or a display panel 6 for displaying a variety of information are provided.

Figure 2:
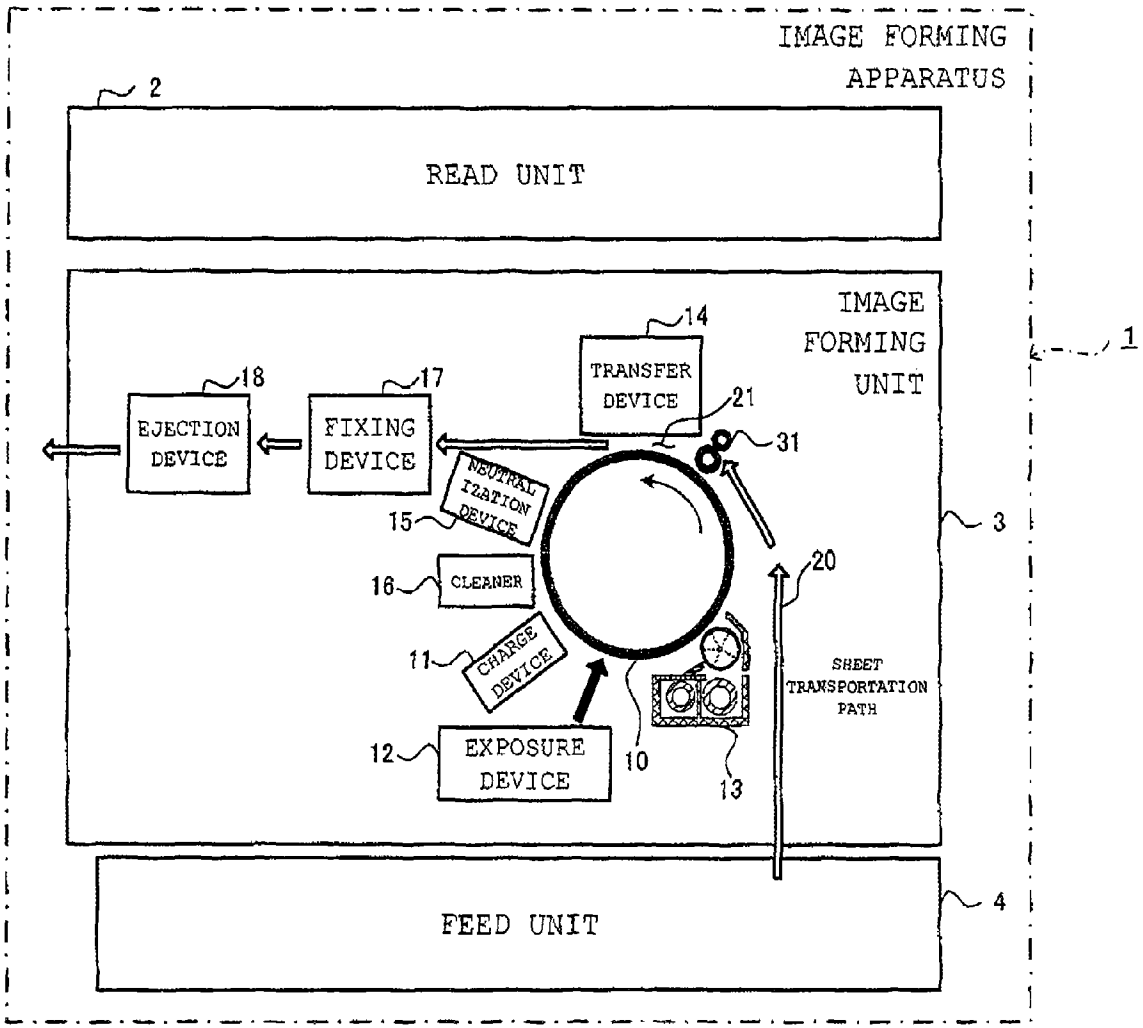
FIG. 2 is a cross-sectional view showing an example of configuration of the image forming apparatus according to the aspect of the present invention.

FIG. 2 is a cross-sectional view schematically showing the internal configuration of the image forming unit 3.

The image forming unit 3 includes in the vicinity of center thereof a photoconductive drum 10 rotating in the direction indicated by an arrow in the figure. In the periphery of the photoconductive drum 10, a charge device 11, an exposure device 12, a development device 13, a transfer device 14, a neutralization device 15 and a cleaner 16 are sequentially arranged from an upstream side to a downstream side of rotation.

The surface of the photoconductive drum 10 is uniformly charged with a predetermined potential by the charge device 11. The exposure device 12 irradiates a laser beam which is modulated according to the level of the image data onto the surface of the photoconductive drum 10. When the laser beam is irradiated, the potential of a portion onto which the laser beam is irradiated is decreased and an electrostatic latent image is formed on the surface of the photoconductive drum 10.

The development device 13 adheres a developer to the surface of the photoconductive drum 10 so as to develop the electrostatic latent image. By developing the electrostatic latent image by a toner which is in the developer, a toner image is formed on the surface of the photoconductive drum 10.

The sheet is transported from the feed unit 4 to a transfer position 21 (a position where the photoconductive drum 10 and the transfer device 14 face each other) through a transportation path 20. The toner image of the photoconductive drum 10 is transferred onto the sheet by the transfer device 14.

A registration roller 31 is provided just before the transfer position 21. A skew of the sheet which occurs in the transportation path 20 from the feed unit 4 to the registration roller 31 is corrected by the registration roller 31. The correction of the skew will be described in detail later.

The sheet onto which the toner image is transferred is transported to the fixing device 17 on the downstream side of the transfer device 14 and the toner image is fixed on the sheet by heating and pressurization. The sheet which is subjected to the fixing process is ejected by the ejection device 18.

The charges are removed from the surface of the photoconductive drum 10 which completes the transfer onto the sheet by the neutralization device 15 and the toner remaining on the surface of the photoconductive drum is removed by the cleaner 16.

Continuous printing can be performed by repeatedly performing the above-described process.

Figure 3:
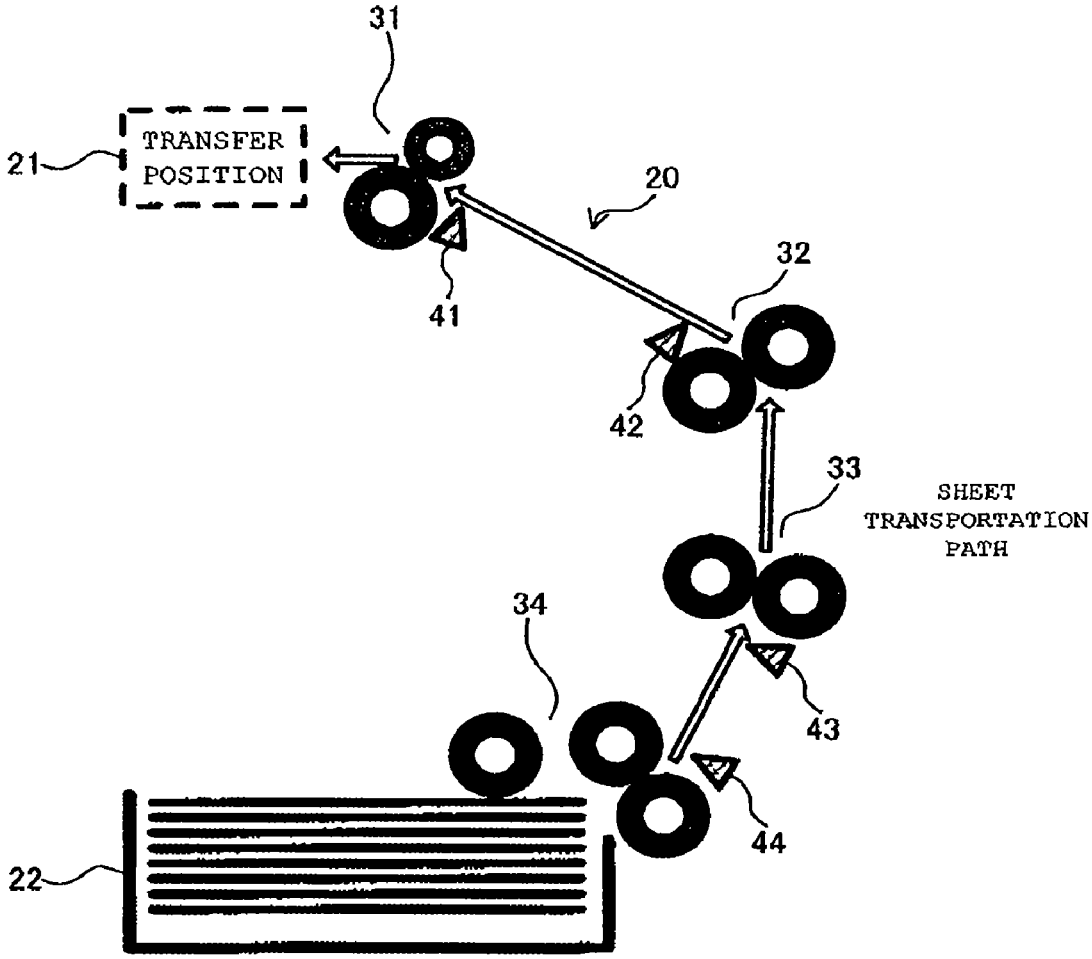
FIG. 3 is a side view showing an example of configuration and an example of arrangement of a roller and a sensor provided on a sheet transportation path.

FIG. 3 is a view schematically showing the configuration of the transportation path 20 of the image forming apparatus 1 according to the present embodiment. The sheet before printing is contained in a feed cassette 22 of the feed unit 4. In the transportation path 20 from the feed cassette 22 to the transfer position 21, a feed roller 34, a transportation roller 33 (third roller), an intermediate transportation roller 32 (second roller), and the registration roller 31 (first roller) are sequentially provided from the feed cassette side.

When printing is instructed from the control panel 5 the sheet is picked up from the feed cassette 22 by the feed roller 34 and is transported by the transportation roller 33 and the intermediate transportation roller 32 so as to reach the registration roller 31.

As described above, the rotation of the registration roller 31 is stopped when the printing is instructed and the front end of the sheet transported from the transportation path 20 is brought into contact with a nip of the stopped registration roller 31. In the case where the skew has occurred in the paper, one end of the front end line of the sheet is first brought into contact with the nip. Even after that, the sheet is continued to be transported from the transportation path 20 by the rotation of the transportation roller 33 or the intermediate transportation roller 32, resulting in that deflection occurs in the vicinity of the end of the sheet which is first brought into contact with the nip. Then, the other end of the sheet also reaches the nip and the front end line of the sheet becomes parallel to the line of the nip. The deviation in the front end line of the sheet is absorbed by the deflection which occurs in the vicinity of the end of the sheet so as to correct the skew. If it is determined that the skew has been corrected and the front end line of the sheet becomes parallel to the line of the nip (that is, if it is determined that the correction of the skew is completed), the rotation of the registration roller 31 is started and the front end line of the sheet is transported to the transfer position.

The completion of the skew correction is determined whether a predetermined period (skew correction period) is elapsed after the front end of the sheet is brought into contact with the nip of the registration roller 31, as stated above. First, a registration sensor 41 provided just before the registration roller 31 detects the passage of the front end of the sheet. Next, if the set skew correction period is elapsed after the registration sensor 41 detects the passage of the front end of the sheet, it is determined that the registration correction is completed. Then, the rotation of the registration roller 31 is started, and the front end of the sheet is guided to the transfer position.

In the transportation path of the sheet, in addition to the registration sensor (first sensor) 41, an intermediate transportation sensor 42 (second sensor) in the vicinity of the intermediate transportation roller 32, a transportation sensor 43 (third sensor) in the vicinity of the transportation roller 33, and a feed sensor 44 in the vicinity of the feed roller 34 are provided.

The passage of the sheet on the transportation path is detected using these four sensors. Each of the sensors is configured to include, for example, a photo sensor. When the front end of the sheet passes through one of the sensors, the sensor is turned on and the time when the sensor is turned on is detected as an ON time. When the rear end of the sheet passes through the sensor, the sensor is turned off and the time when the sensor is turned off is detected as an OFF time. The state of the passage of the sheet can be detected on the basis of the ON times and the OFF times detected by each of the sensors. When paper jam occurs on the transportation path, it can be determined whether the paper jam occurs or not, and a position where the paper jam occurs can be specified, using information on the ON times and the OFF times detected by these sensors.

In the image forming apparatus 1 according to the present embodiment, these sensors are used for detecting the skew as well as detecting the paper jam by adjusting the arrangement of the sensors.

Figure 4:
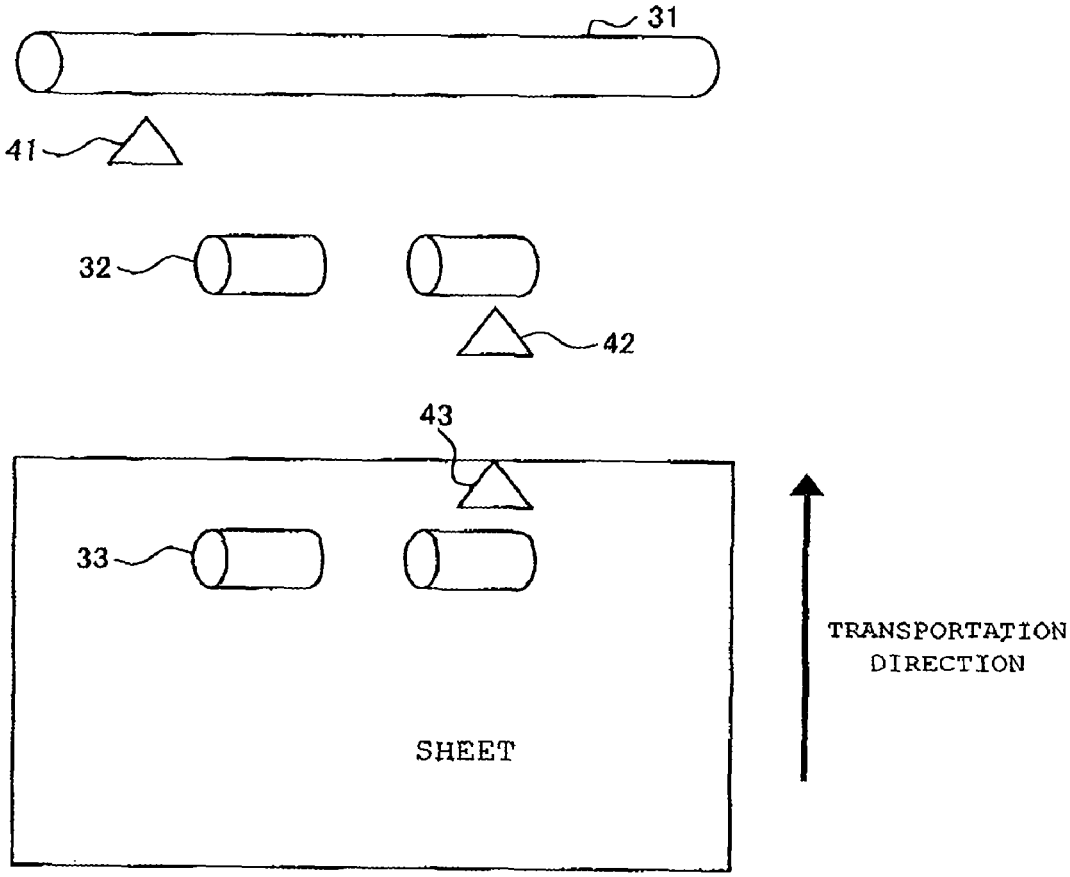
FIG. 4 is a plan view showing the example of configuration and the example of arrangement of the roller and the sensor provided on the sheet transportation path.

FIG. 4 is a view showing the arrangement of the transportation sensor 43, the intermediate transportation sensor 42 and the registration sensor 41 used for detecting the skew, which are two-dimensionally deployed in a transportation direction of the sheet and a direction perpendicular thereto.

As can be seen from FIG. 4, the registration sensor 41 (first sensor) is provided just before the registration roller 31 and is located apart from the center of the registration roller 31. The position of the intermediate transportation sensor 42 (second sensor) is different from the position of the registration sensor 41 in the transportation direction of the sheet and in the direction perpendicular to the transportation direction. That is, the registration sensor 41 and the intermediate transportation sensor 42 are provided as inclined with respect to the transportation direction of the sheet.

The position of the transportation sensor 43 (third sensor) is different from the position of the intermediate transportation sensor 42 in the transportation direction of the sheet but is equal to the position of the intermediate transportation sensor in the direction perpendicular to the transportation direction. That is, the transportation sensor 43 and the intermediate transportation sensor 42 are arranged in parallel to the transportation direction of the sheet.

(2) Sheet Transporting Method

Hereinafter, the method for transporting the sheet in the image forming apparatus 1 having the above-described configuration, and more particularly, the method for detecting the skew of the paper and the method for correcting the skew will be described.

Figure 5:
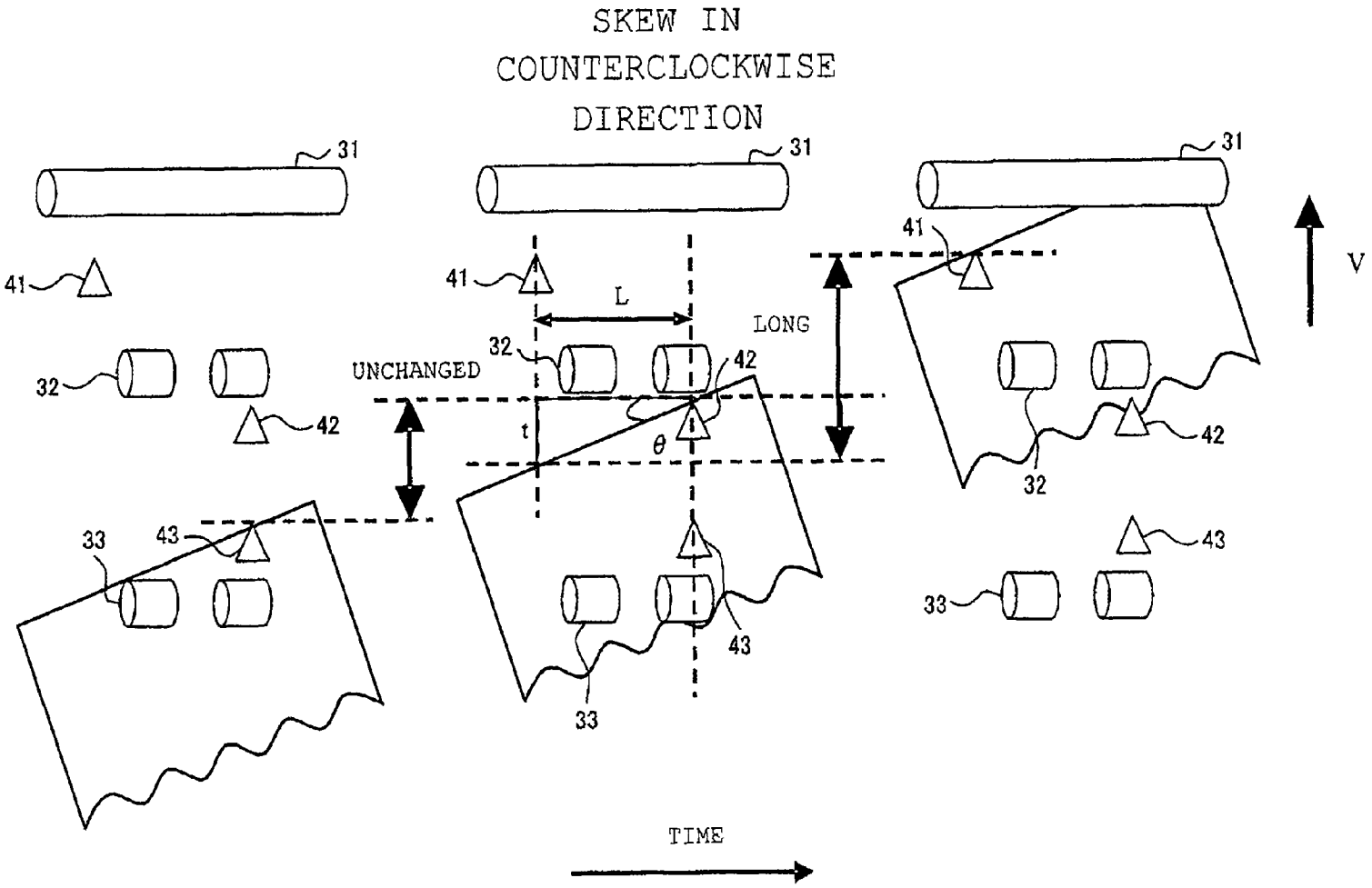
FIG. 5 is a first view (skew of a counterclockwise direction) explaining the principle of the detection of a skew amount according to the present embodiment.
Figure 6:
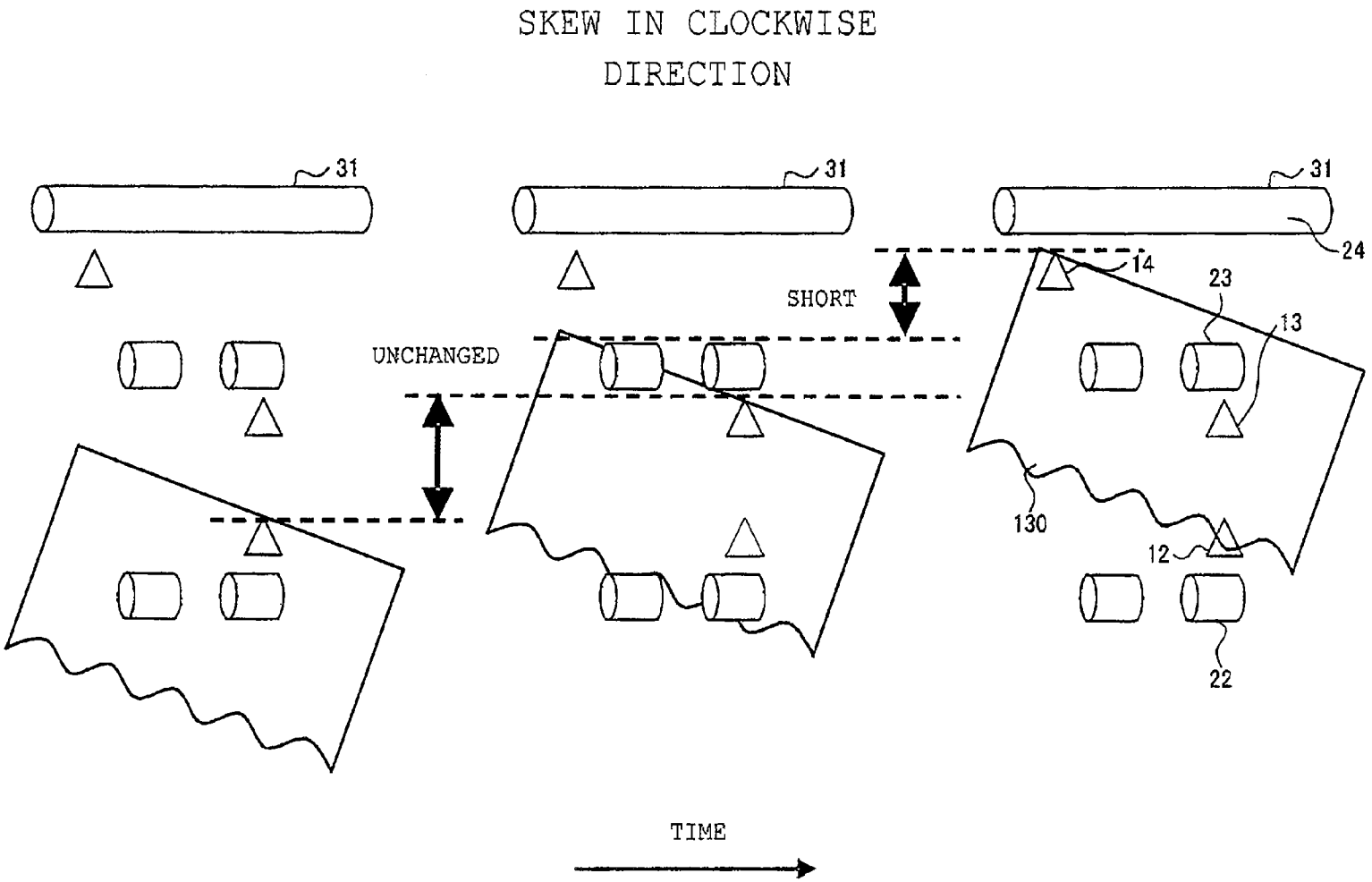
FIG. 6 is a second view (skew of a clockwise direction) explaining the principle of the detection of the skew amount according to the present embodiment.

FIGS. 5 and 6 are views explaining the principle of the method for detecting the skew of the present embodiment. FIG. 5 shows a state in which the skew occurs in a counterclockwise direction and FIG. 6 shows a state in which the skew occurs in a clockwise direction.

The left side of FIG. 5 shows a state in which the front end of the sheet passes through the position of the transportation sensor 43 in a state in which the skew has occurred in the counterclockwise direction. The central side of FIG. 5 shows a state in which the sheet is further transported and the front end of the sheet passes through the position of the intermediate transportation sensor 42. The right side of FIG. 5 shows a state in which the sheet is further transported and the front end of the sheet passes through the position of the registration sensor 41.

As described above, since the transportation sensor 43 and the intermediate transportation sensor 42 are provided in parallel to the transportation direction of the sheet, a period when the sheet passes through the two sensors is equal in a normal state in which the sheet is not skewed and in a state in which the sheet is skewed.

Since the intermediate transportation sensor 42 and the registration sensor 41 are provided as inclined with respect to the transportation direction of the sheet, the period when the sheet passes through the two sensors is different in a normal state in which the sheet is not skewed and in a state in which the sheet is skewed. As shown in FIG. 5, a sheet passage period T while the front end of the sheet passes between the intermediate transportation sensor 42 and the registration sensor 41 when the sheet is skewed in the counterclockwise direction is longer than a normal sheet passage period T0 while the front end of the sheet passes between the intermediate transportation sensor 42 and the registration sensor 41 when the sheet is not skewed (T>T0).

Similarly, as shown in FIG. 6, the sheet passage period T while the front end of the sheet passes between the intermediate transportation sensor 42 and the registration sensor 41 when the sheet is skewed in the clockwise direction is different from the normal sheet passage period T0 when the sheet is not skewed. In this case, the sheet passage period T when the sheet is skewed is shorter than the normal sheet passage period T0 when the sheet is not skewed (T<T0).

A skew amount of the sheet is expressed by a skew angle θ (see the central illustration of FIG. 5). When a distance between the registration sensor 41 and the intermediate transportation sensor 42 in the direction perpendicular to the transportation direction is L and the transportation velocity of the sheet is V0, the skew angle θ is expressed by the following Equation 1;

$$\tan(\theta)=ABS(T-T0)\cdot(V0/L) \quad \text{(Equation 1)},$$

where, ABS( ) is an operator for obtaining an absolute value. The normal sheet passage period T0 when the sheet is not skewed, the transportation velocity V0 of the sheet, and the distance L are determined and given in advance.

The sheet passage period T of Equation 1 can be calculated by a difference (T=t1−t2) between a time (second passage time t2) when the front end of the sheet passes through the intermediate transportation sensor 42 and a time (first passage time t1) when the front end of the sheet passes through the registration sensor 41. The skew angle θ can be calculated from Equation 1 on the basis of the period T, including above-mentioned T0, V0 and L.

Incidentally, the transportation velocity V0 of the sheet used in Equation 1 is a normal transportation velocity when abrasion does not occur in the rollers. Accordingly, if the abrasion occurs in the roller and an actual transportation velocity V is significantly deviated from the normal transportation velocity V0, an error may be raised in the skew angle obtained using Equation 1.

In the present embodiment, it is determined whether the actual transportation velocity V is significantly deviated from the normal transportation velocity V0, on the basis of the time (second passage time t2) when the front end of the sheet passes through the intermediate transportation sensor 42 and a passage time (third passage time t3) of the transportation sensor 43, these two sensors 42 and 43 being arranged in parallel to the transportation direction.

In the above description, it is the passage time of the front end of the sheet that the sensors detect, however, the passage time of the rear end of the sheet may be detected alternatively.

Figure 7:
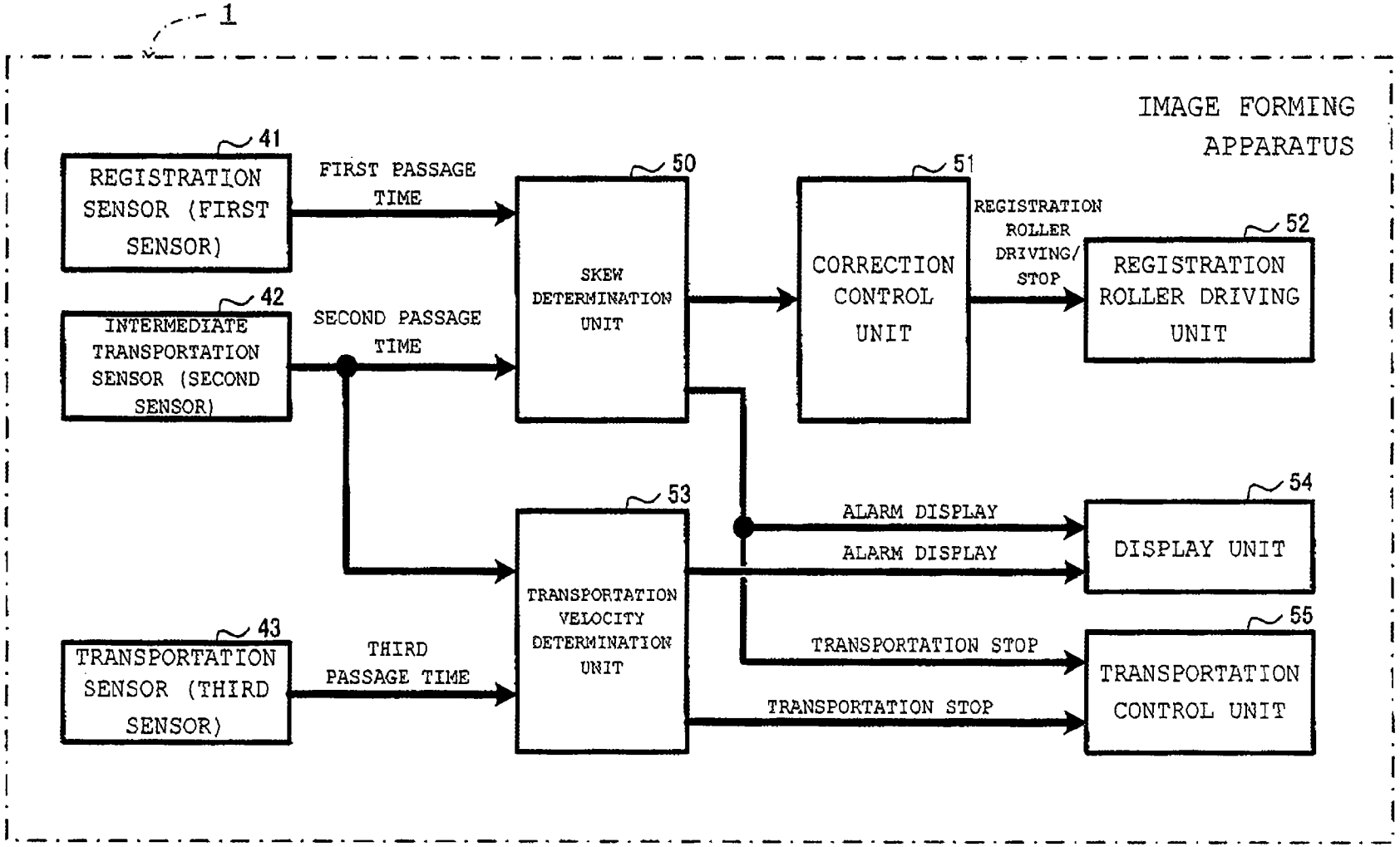
FIG. 7 is a functional block diagram mainly showing a process of determining a skew amount and a process of correcting a skew according to the present embodiment.

FIG. 7 is a functional block diagram showing the functions related to the detection of the skew amount and the correction of the skew based on the skew amount, among the functions of the image forming apparatus 1 according to the present embodiment. The image forming apparatus 1 includes, in order to realize these functions, a skew determination unit 50, a correction control unit 51, a registration roller driving unit 52, a transportation velocity determination unit 53, a display unit 54, and a transportation control unit 55, in addition to the sensors including the registration sensor 41, the intermediate transportation sensor 42 and the transportation sensor 43.

Figure 8:
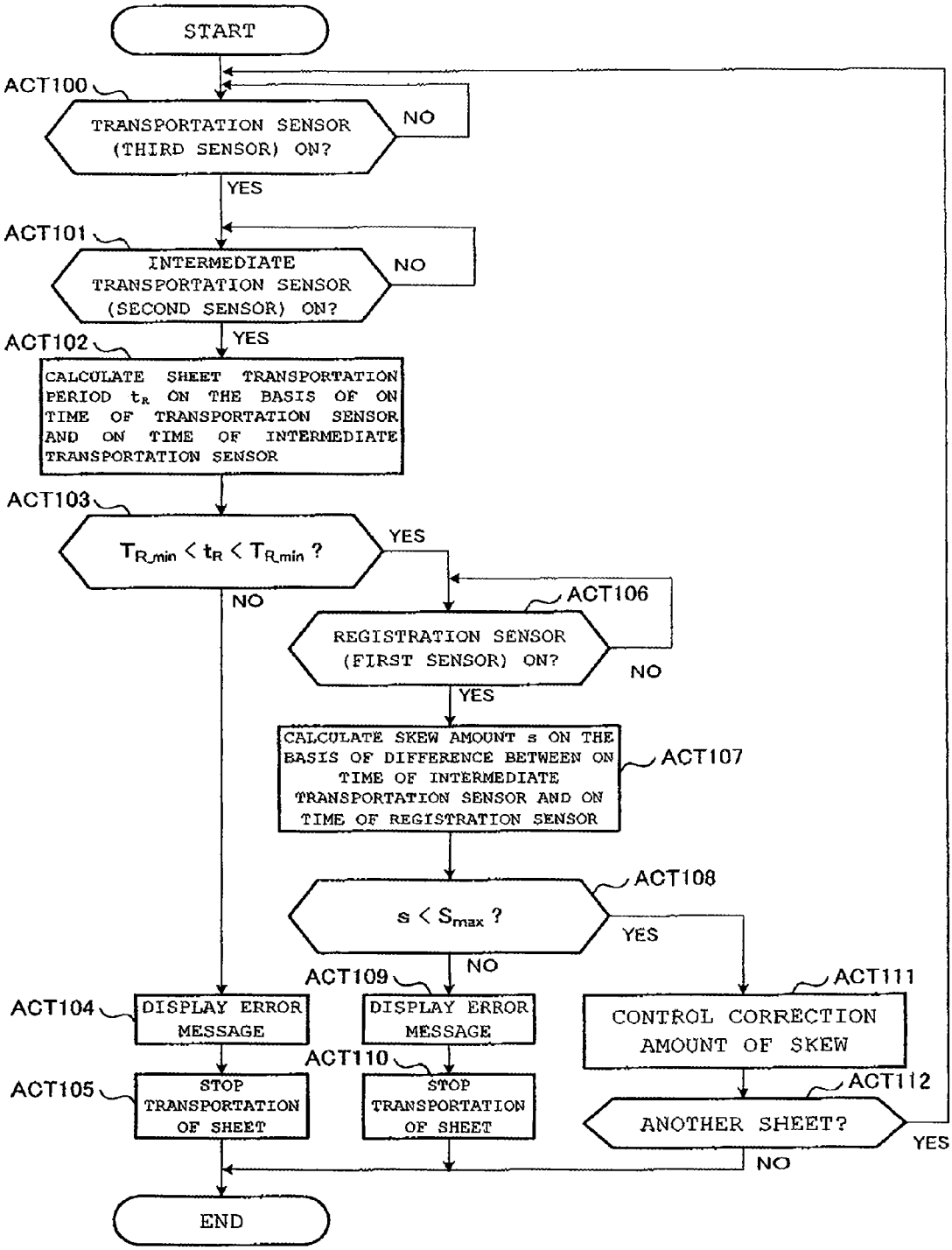
FIG. 8 is a flowchart mainly showing an example of the process of determining the skew amount and the process of correcting the skew according to the present embodiment.

FIG. 8 is a flowchart showing the detection of the skew amount and the correction of the skew in the sheet transporting method according to the present embodiment. The process will be described along with the flow of the flowchart by referring to the functional block diagram of FIG. 7.

In Act 100, the transportation sensor 43 (third sensor) is waited to be turned on and, when the transportation sensor is turned on, the ON time t3 (third passage time) is properly stored in a memory.

In Act 101, the intermediate transportation sensor 42 (second sensor) is waited to be turned on and, when the intermediate transportation sensor is turned on, the ON time t2 (second passage time) is properly stored in the memory.

In Act 102, a period $t_R$ while the sheet is transported from the transportation sensor 43 to the intermediate transportation sensor 42 is calculated by a difference ($t_R$=t2−t3) between the ON time t3 detected by the transportation sensor 43 and the ON time t2 detected by the intermediate transportation sensor 42.

In Act 103, it is determined whether the transportation period $t_R$ obtained by Act 102 is in a predetermined range (a range from a minimum value $T_{R_min}$ to a maximum value $T_{R_max}$) ($T_{R_min}<t_R<T_{R_max}$).

In Act 103, if it is determined that the transportation period $t_R$ is not in the predetermined range, it is estimated that the transportation velocity V0 of the sheet is not normal due to the abrasion or the like of the roller such as the transportation roller 33 or the intermediate transportation roller 32.

Accordingly, in this case, even if the skew amount is determined on the basis of the transportation velocity V0, the skew amount obtained is not accurately. Therefore, the process of determining the skew amount (Act 106, Act 107 and Act 108) is not performed.

In this case, an error message indicating that the transportation velocity V0 is not normal may be displayed on the display unit 54 (Act 104).

In addition, since it is determined that the transportation velocity V0 of the sheet is not normal, the transportation control unit 55 for controlling the transportation of the sheet may be instructed to stop the transportation of the sheet (Act 105).

The processes from Act 100 to Act 105 are mainly performed by the transportation velocity determination unit 53 (see FIG. 7).

In contrast, if it is determined that the transportation velocity of the sheet is normal (YES of Act 103), the skew amount s (more particularly, the skew angle θ) is determined.

In Act 106, the registration sensor 41 (first sensor) is waited to be turned on and, when the registration sensor is turned on, the ON time t1 (first passage time) is properly stored in the memory.

In Act 107, the skew amount s (skew angle θ) is calculated based on the ON time t2 of the intermediated transportation sensor 42 and the ON time t1 of the registration sensor 41 which are detected in advance. In more detail, the difference (T=t1−t2) between the ON time t1 of the registration sensor 41 and the ON time t2 of the intermediate transportation sensor 42 is obtained and the obtained period T is substituted for Equation 1 such that the skew amount s (skew angle θ) is obtained.

As the transportation velocity V0 of the sheet in Equation 1, the standard transportation velocity in the normal state may be used, or alternatively, the actual transportation velocity (if it is determined that the transportation velocity is normal in Act 103) at the current time point may be used from the transportation period $t_R$ obtained in Act 102.

In Act 108, it is determined whether the skew amount s (skew angle θ) calculated in Act 107 exceeds a predetermined limit value Smax or not. When the skew amount s (skew angle θ) exceeds the predetermined limit value Smax, the skew amount s (skew angle θ) is considered to be so large that the correction of the skew can not properly performed by the registration roller 31.

Accordingly, in this case, it is preferable that an error message indicating that the skew amount s (skew angle θ) exceeds the correctable limit value be displayed on the display unit 54 (Act 109), and the transportation control unit 55 be instructed to stop the transportation of the sheet (Act 110). For the case where the skew amount is increased than expected, it becomes possible to prevent paper wrinkle or paper jam from occurring by attracting the attention of a user by the display of the error message or by stopping the transportation of the sheet in advance.

The processes from Act 106 to Act 110 are mainly performed by the skew determination unit.

In contrast, if the skew amount s (skew angle θ) is lower than the predetermined limit value Smax, the skew is corrected using the registration roller 31. In particular, in the image forming apparatus 1 according to the present embodiment, the skew correction amount based on the skew amount s (skew angle θ) calculated in Act 107 is adjusted (Act 111).

The skew correction amount is a span of time from a time when the front end of the sheet is brought into contact with the stopped registration roller 41 to a time when the rotation of the registration roller 41 is started, that is, a skew correction period.

If the skew amount s (skew angle θ) is small, the skew correction period is set to be short and, if the skew amount s (skew angle θ) is large, the skew correction period is set to be long.

Since the skew correction period is adjusted according to the level of the skew amount s (skew angle θ), it becomes possible to improve throughput by setting the skew correction period to be short when the skew amount s (skew angle θ) is small, while realizing proper skew correction.

Thus far, above-mentioned procedures are explained based on the arrangement of the sensors shown in FIG. 4. However, the arrangement of the sensors, (the transportation sensor 43, the intermediate transportation sensor 42 and the registration sensor 41) is not limited to the arrangement of FIG. 4.

Figure 9:
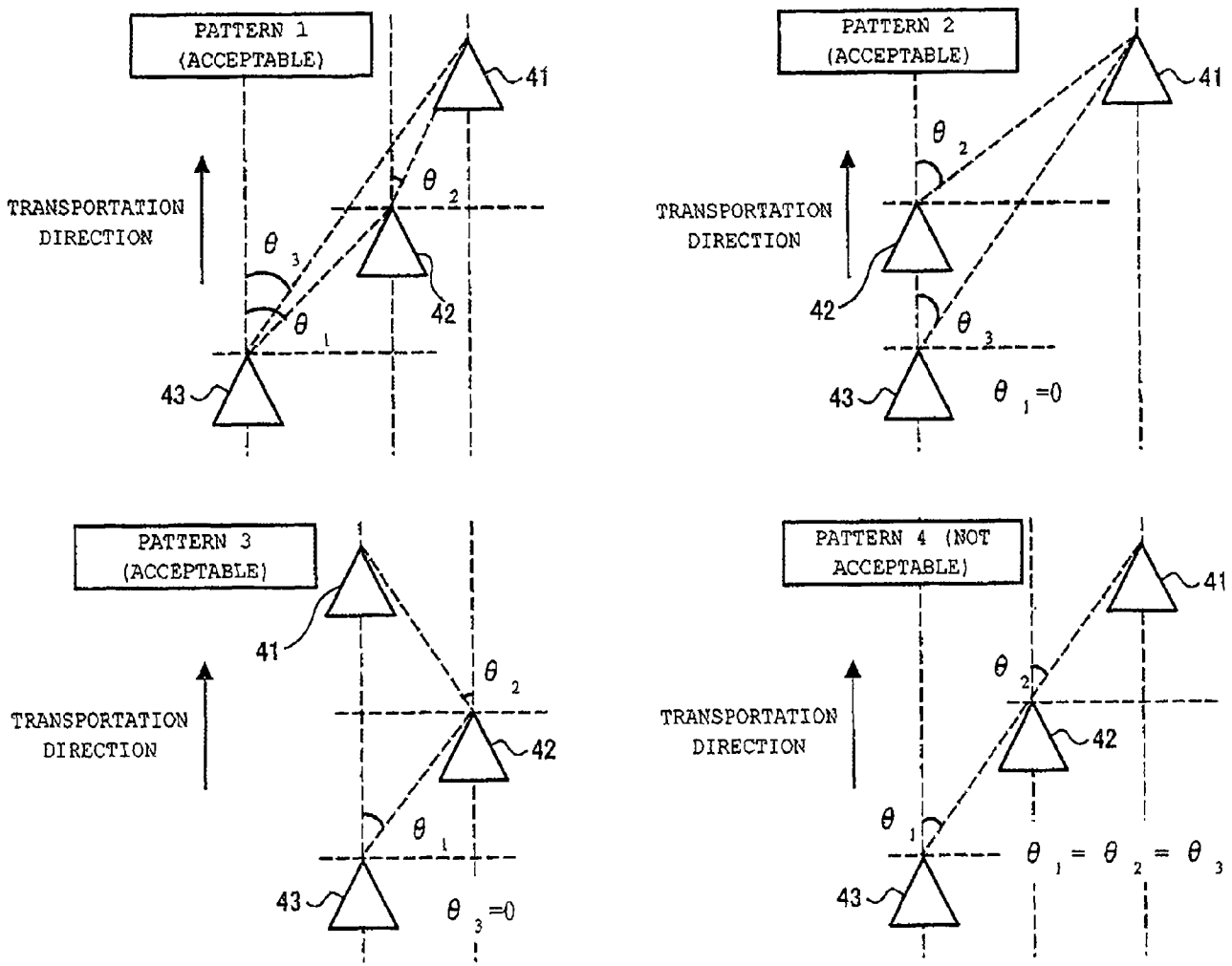
FIG. 9 is a view showing an example of arrangement of a sensor necessary for determining the skew amount and determining a sheet transportation velocity.

FIG. 9 is a view showing arrangement examples (pattern 1, pattern 2 and pattern 3) which can be applied to the image forming apparatus 1 according to the present embodiment and an arrangement example (pattern 4) which can not be applied to the image forming apparatus according to the present embodiment.

The registration sensor 41 and the intermediate transportation sensor 42 for detecting the skew angle need to be arranged at different positions in both the transportation direction of the sheet and the direction perpendicular thereto. On the other hand, the transportation sensor 43 may be freely arranged as shown in the pattern 1, the pattern 2 and the pattern 3 unless it is arranged on the line connecting the registration sensor 41 and the intermediate transportation sensor 42 as in the pattern 4.

As described above, according to the image forming apparatus 1 and the method for transporting the sheet thereof of the present embodiment, it is possible to accurately detect the skew amount of the sheet and properly correct a skew according to the detected skew amount without adding a special sensor, even when a transportation period is changed by abrasion of a roller or the like.

The present invention is not limited to the above-described embodiments and may be modified without departing from the scope of the present invention. Various embodiments may be embodied by proper combinations of the plurality of components disclosed in the above-described embodiments. For example, several components may be omitted from the above-described embodiments. The components of the different embodiments may be properly combined.

What is claimed is:

1. An image forming apparatus comprising:

a first sensor which is provided on a transportation path of a sheet and detects a first passage time of the sheet;

a second sensor which is provided at a position different from the position of the first sensor in a transportation direction of the sheet and a direction perpendicular to the transportation direction and detects a second passage time of the sheet;

a skew determination unit which determines a skew amount of the sheet based on a difference between the first passage time detected by the first sensor and the second passage time detected by the second sensor;

a correction control unit which performs control for correcting a skew of the sheet on the basis of the skew amount determined by the skew determination unit; and a display unit which displays a message indicating that the skew amount is larger than a predetermined reference value, if the skew amount determined by the skew determination unit is larger than the predetermined reference value.

2. The apparatus according to claim 1, wherein:

the skew amount is a skew angle, and the skew determination unit determines the skew angle based on at least the difference between the first passage time and the second passage time.

3. The apparatus according to claim 2, wherein, the skew determination unit determines the skew angle based on the following equation:

$$\tan\theta = ABS(T-T0)\cdot(V/L),$$

wherein, T is a sheet passage period obtained from the difference between the first passage time t1 and the second passage time t2, T0 is a normal sheet passage period between the first sensor and the second sensor when the sheet is not skewed, L is a distance between the first sensor and the second sensor in the direction perpendicular to the transportation direction, and v is a transportation velocity of the sheet.

4. The apparatus according to claim 1, further comprising a transportation control unit which controls the transportation of the sheet, wherein the transportation control unit stops the transportation of the sheet if the skew amount determined by the skew determination unit is larger than a predetermined reference value.

5. The apparatus according to claim 1, further comprising a registration roller, wherein the correction control unit controls, on the basis of the skew amount, a span of time from a time when a portion of a front end of the sheet is brought into contact with a nip of the stopped registration roller to a time when the transportation of the sheet to a downstream side is started by the rotation of the registration roller.

6. The apparatus according to claim 1, further comprising:

a third sensor which is provided in the transportation path of the sheet at a position deviated from a straight line connecting the position of the first sensor and the position of the second sensor, and detects a third passage time of the sheet; and a transportation velocity determination unit which determines the transportation velocity of the sheet by the third passage time detected by the third sensor and at least one of the first passage time and the second passage time, wherein the skew determination unit determines the skew amount when the transportation velocity determined by the transportation velocity determination unit is in a predetermined range.

7. The apparatus according to claim 6, wherein the correction control unit performs the control for correcting the skew of the sheet when the transportation velocity determined by the transportation velocity determination unit is in the predetermined range.

8. The apparatus according to claim 6, wherein the display unit displays a message indicating that the transportation velocity is outside the predetermined range if the transportation velocity determined by the transportation velocity determination unit is outside the predetermined range.

9. The apparatus according to claim 6, further comprising a transportation control unit which controls the transportation of the sheet, wherein the transportation control unit stops the transportation of the sheet if the transportation velocity determined by the transportation velocity determination unit is outside the predetermined range.

10. A method for transporting a sheet, the method comprising:

detecting a first passage time of the sheet by a first sensor provided on a transportation path of the sheet;

detecting a second passage time of the sheet by a second sensor which is provided at a position different from the position of the first sensor in a transportation direction of the sheet and a direction perpendicular to the transportation direction;

determining a skew amount of the sheet based on a difference between the first passage time detected by the first sensor and the second passage time detected by the second sensor;

controlling correction of a skew of the sheet on the basis of the skew amount and displaying, if the determined skew amount is larger than a predetermined reference value, a message indicating that the skew amount is larger than the predetermined reference value.

11. The method according to claim 10, wherein:

the skew amount is a skew angle, and in the determining of the skew amount, the skew angle is determined based on at least the difference between the first passage time and the second passage time.

12. The method according to claim 11, wherein, in the determining of the skew amount, the skew angle is determined based on the following equation:

$$\tan\theta = ABS(T-T0)\cdot(V/L),$$

wherein, T is a sheet passage period obtained from the difference between the first passage time t1 and the second passage time t2, T0 is a normal sheet passage period between the first sensor and the second sensor when the sheet is not skewed, L is a distance between the first sensor and the second sensor in the direction perpendicular to the transportation direction, and v is a transportation velocity of the sheet.

13. The method according to claim 10, further comprising controlling the transportation of the sheet, wherein, in the controlling of the transportation, the transportation of the sheet is stopped if the determined skew amount is larger than a predetermined reference value.

14. The method according to claim 10, wherein, in the controlling the correction of the skew, a span of time from a time when a portion of a front end of the sheet is brought into contact with a nip of a stopped registration roller to a time when the transportation of the sheet to a downstream side is started by the rotation of the registration roller is controlled on the basis of the skew amount.

15. The method according to claim 10, further comprising:

detecting a third passage time of the sheet by a third sensor which is provided in the transportation path of the sheet at a position deviated from a straight line connecting the position of the first sensor and the position of the second sensor; and determining the transportation velocity of the sheet by the third passage time detected by the third sensor and at least one of the first passage time and the second passage time, wherein, in the determining of the skew amount, the skew amount is determined when the determined transportation velocity is in a predetermined range.

16. The method according to claim 15, wherein, in the controlling the correction of the skew, the control for correcting the skew of the sheet is performed when the determined transportation velocity is in the predetermined range.

17. The method according to claim 15, further comprising displaying a message indicating that the transportation velocity is outside the predetermined range if the determined transportation velocity is outside the predetermined range.

18. The method according to claim 15, further comprising controlling the transportation of the sheet, wherein, in the controlling of the transportation, the transportation of the sheet is stopped if the determined transportation velocity is outside the predetermined range.

* * * * *